US006233204B1

(12) United States Patent
Chu et al.

(10) Patent No.: US 6,233,204 B1
(45) Date of Patent: May 15, 2001

(54) BOARD FOR DISPLAYING UNIVERSAL TIME

(76) Inventors: Sheng-Pen Chu; Wen-Chi Chu; Wen-Ching Chu, all of P.O. Box 55-175, Taichung (TW)

( * ) Notice: Subject to any disclaimer, the term of this patent is extended or adjusted under 35 U.S.C. 154(b) by 0 days.

(21) Appl. No.: 08/746,494

(22) Filed: Nov. 12, 1996

(51) Int. Cl.[7] ..... G04B 19/22
(52) U.S. Cl. ..... 368/21; 368/23
(58) Field of Search ..... 368/10, 21–24; 283/34, 35; 340/990–995

(56) References Cited

U.S. PATENT DOCUMENTS

| | | | | |
|---|---|---|---|---|
| 4,435,086 | * | 3/1984 | Kato | 368/22 |
| 4,681,460 | * | 7/1987 | Nishimura | 368/21 |
| 4,779,247 | * | 10/1988 | Uchida | 368/22 |
| 4,899,293 | * | 2/1990 | Dawson et al. | 364/521 |
| 4,998,229 | * | 3/1991 | Kubona | 368/21 |
| 5,007,033 | * | 4/1991 | Kubota et al. | 368/21 |

* cited by examiner

*Primary Examiner*—Vit W. Miska

(57) ABSTRACT

A time board for dynamically displaying the universal time is provided, the board is adaptable to hang on the wall of lounge of an airport, a main railroad station hall, a passenger terminal of a harbor, the office of tele-communication and the classroom of a school, and comprises a flat rectangular board having front panel on which a world map of Mercator Equator Projection is attached containing every country and region of the world which are covered by 24 time zones, each of the time zone occupies 15 degrees longitudes repersenting an hour. An universal date display column and an universal hour display column parallel extend adjacent an upper border of the board from left to right margin thereof each contains 25 display windows spaced apart and in cooperation with the 24 time zones for inserting binary numbered LEDs to dynamically display the date and time differences around the world. A local time column displays the hour, minute and second of the local time and works in concert with hours displayed in the time zones. The improvement has been characterized in the alteration of the conventional ways to obtain the universal time differences in order to suit to the popularity. The world map may be variable to facilitate every country or regions have equal chance to be centered in the map.

10 Claims, 10 Drawing Sheets

BOARD FOR DISPLAYING UNIVERSAL TIME

BACKGROUND OF THE INVENTION

The present invention relates to world timepieces, and more particularly to a board for progressively displaying the universal time of every time zone and the time differences between the local time and everywhere in the world so as to facilitate a commercial traveller or a tourist to know the exact time of their destination at a glance and to help a teacher to show the time differences of the world in an astronomical class.

Hundred thousands commercial, trade or sightseeing travellers travelling daily in the world need to know the exact time at the departure and arrival between two terminus of their travelling. Since they understand that being punctual is very important for them, but most of them don't know how to obtain the date and the time different at their destinations. In order to meet the requirement mentioned above, various world timepieces have been disclosed heretofore, wherein the most typical prior art world timepieces are the Zone Time Display Clocks, U.S. Pat. No. 3,186,158 and U.S. Pat. No. 3,940,920, which include a world map on a small panel can selectively show the time differences for number of large cities in the world and which are adaptable to whom he is skillfull to operate it personally. U.S. Pat. No. 4,502,789 and 4,945,521 disclosed a clock and a watch, the former of which disposes a rotatable disk including thereon a world map of polar projection into a circular casing. A series of radially extended longitudes of 15° in interval on the map made in registry with a twenty-four hour scale around the circumference of the casing so that the user can visually obtain the time differences of every time zone upon the rotation of the disk. The later depicts a series of concentrical circles on a stationary dial face in which separately indicates the scales of local hours, minutes, the time defferences of 24 time zones and a selected number of major city names in the world, in addition to a plurality of arms coaxially rotate on a central shaft for respectively pointing the scales. This clock or watch is too small to contain informations enough to satisfy user's requirement, and the users feel difficult to read those invisible informations inversibly. U.S. Pat. No. 4,998,229 and 5,007,033 then disclosed a programmable world timepiece which is made of a calculator and includes a display unit normally displaying local time or selectively showing the present time of main cities in the world by pressing a plurality of selector switches in the lower portion. This calculator type world timepiece can also serve for skillfull personal only. So that the aforediscussed prior art world timepieces are of limited function and can not serve for the popularity of the travellers.

Finally, U.S. Pat. No. 2,299,913 discloses a world clock which is of a time display board on which attaches a transparent world map including 24 time zones thereon and incorporated with a time scale of doubled 12 hours on the top thereof. A plurality of colored incandescent bulbs actuated by a plenty of electronic mechanisms for selectively emanating the lights to imitating day or night on the map. But it could not show the transition of the date. Besides, it's mechanism is too complicated to manufacture. This is the reason why it has not come up to realization. Instead of the above world timepieces, a number of clock are arranged in an alignment on a wall in a lounge of an airport, a passenger terminal of a harbour or of a station hall. Each of these clocks tells the time difference of a major city around the world. This arrangement is quite limited to tell the time differences of few major cities and that they need to be adjusted frequently disregarding of whether or not they are operated by A.C. current, therefore causing inconvenience.

SUMMARY OF THE PRESENT INVENTION

The present invention has a main object to provide a board for dynamically displaying universal time which not only indicates the geographical positions of the countries and major cities within the 24 time zones of the world but also tells the transition of the date and the hours in the time zones in order to meet the requirement of the commercial and sightseeing travellers and the education.

Another object of the pesent invention is to provide a board for dynamically displaying universal time on which the date is changed daily and automatically according to the International Date Line and the time is changed hourly and synchroneously at every time zone and increases eastward in arismetic progression so as to avoid the appearance of the negative numerals in the time zones.

Still another object of the present invention is to provide a board for dynamically displaying universal time, by utilizing the charactor of the Mercator Equator projection that the central maridian is selective, the time zones on the board are shiftable to facilitate every country or region to be centralized in the world map so that the map can be variable in accordance with the geographical position of the countries of the world.

Further object of the present invention is to provide a board for dynamically displaying universal time in which a plurality of LED incorporated with a plurality of IC plates of series circuit are disposed and controlled by a CPU circuit plate including a memory in which a calendar program good for any future years has been inputed so that the date and time are changed continuously and accurately in accordance with the real situation such as the usual year, Leap year and the different days of months.

Still further object of the present invention is to provide a board for dynamically displaying universal time including a control device which adjusts the date and time of every display window in order to conforming with the shift of positions of the time zones.

A furthermore object of the present invention is to provide a board for dynamically displaying universal time having a local time column at a lower central portion which displays the local hours, minutes and seconds against the GMT time and acted in uniform with the time shift of the universal time column and can be preset at a destination time when the board is used in an aircraft or a merchant marine for controlling the operation of the crew and the time of arrival.

Accordingly, the board for dynamically displaying universal time of the present invention comprises generally a hollow interior rectangular board which is made from suitable rigid material and is sizeably variable, and attached to the front of which is a world map compiled of Mercator Equator Projection having longitudinal interval of 15 degrees so as to divide the world into 24 time zones. Since that the International Date Line is superposed on the 180th longitude and the time zone ±12 is also centered at this longitude, so that this time zone must be widened doubly to allow two different dates in same hour. The Latidudinal interval of the world map is shortened in order to prevent the countries in high latitude from over enlarged. It is understood that the central maridian of the Mercator Equator projection is selective so as to permit any country or region in the world to be centered in the map. This provides an advantage of making various world map to serve for different countries. An universal date column incorporated with an universal hour column on the upper portion of the board in which a plurality of display windows are parallel formed spaced apart for disposing the LEDs therein. The LEDs indicate the shift of the date and the time synchroneously in cope with each of the 24 time zones and connect respectively with a plurality of IC plates which are of series circuit and connect to a CPU circuit so as to be controlled by the CPU circuit. The time zones are designated by English letters in accordance with the international criterion. Each time zone has a color block at the upper end with a first transparent color indicating the odd numbered time zones and the countries therewithin and a second transparent color indicating the even numbered time zones and countries or regions therewithin. A third transparent color is applied to the countries or areas keeping time that differs by less than one hour from the standard time of zone in which they lie. Some countries who adopt "Summer time" or "Winter time" are indicated by suitable symbol such as a star and/or the like. This arrangement intends to simplize the complicated system of the time zones and flattens the spherical information on a planar surface so as to facilitate people to readily understand at a glance in order to achieve popularity and publicity of the time board.

The present invention will become more fully understood by reference to the following detailed description thereof when read in conjunction with the attached drawings.

DETAILED DESCRIPTION OF THE PREFERRED EMBODIMENT

Figure 1:
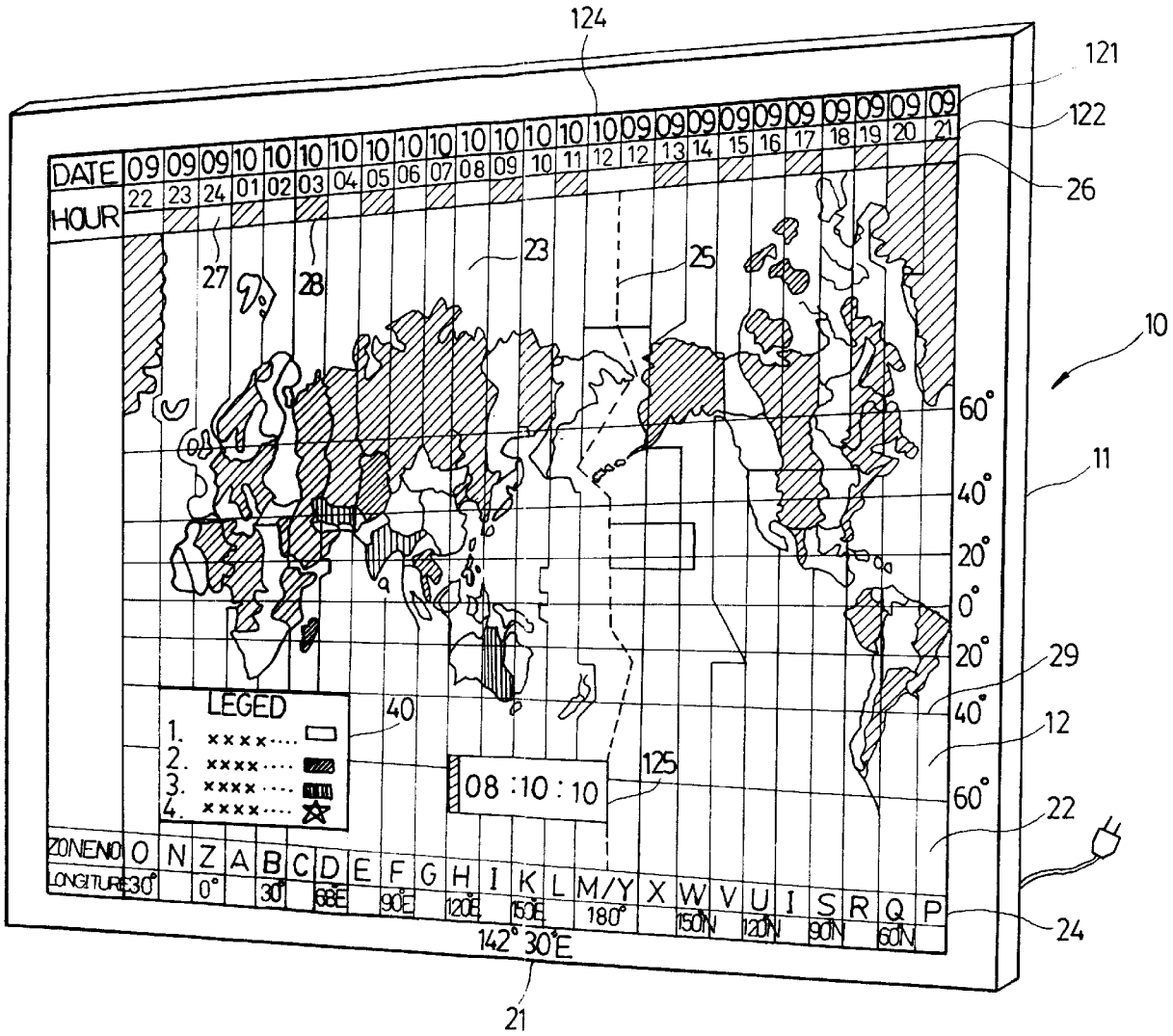
FIG. 1 is a perspective view to show a preferred embodiment of the present invention.
Figure 2:
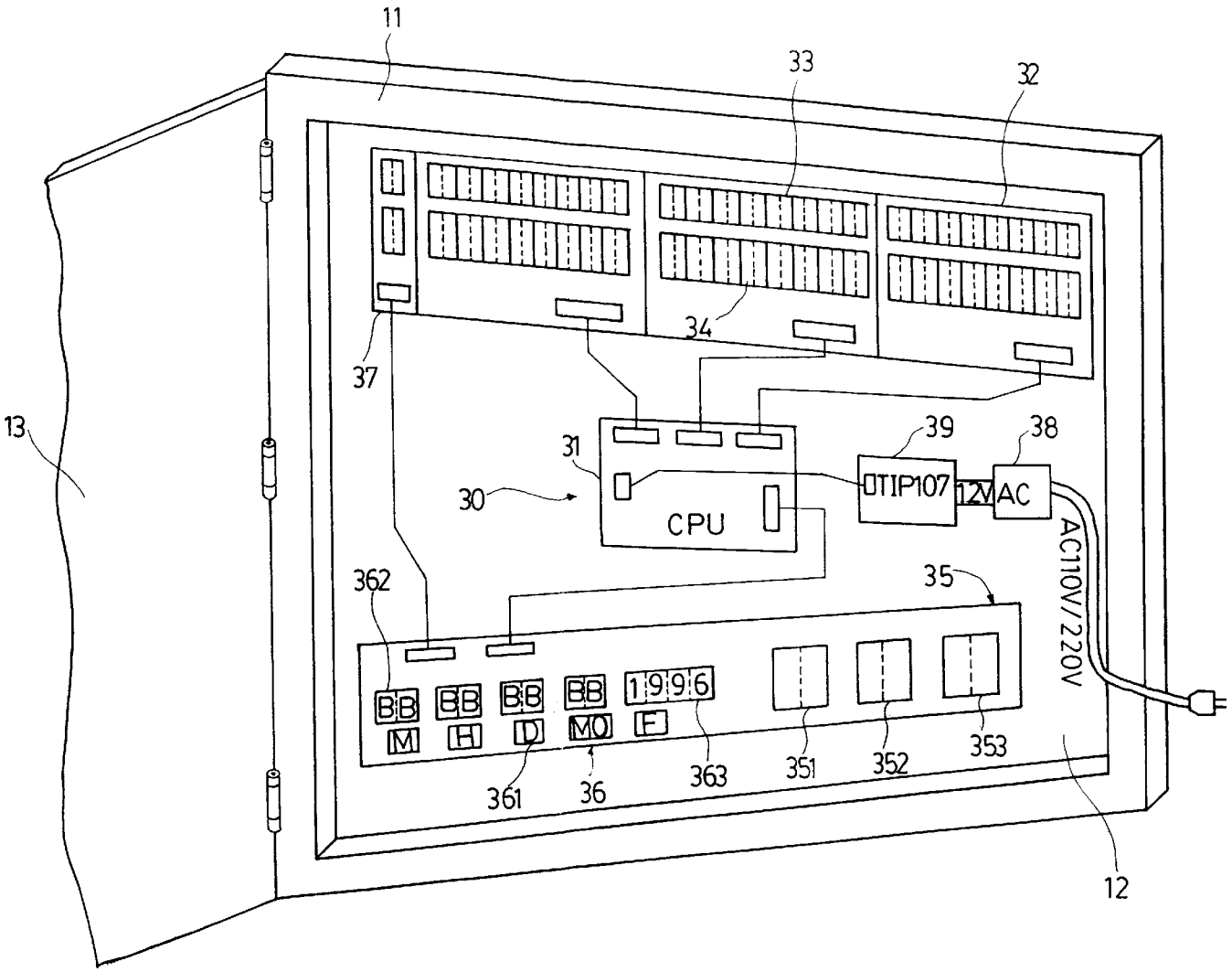
FIG. 2 is a rear side view of FIG. 1.

With reference to FIGS. 1 and 2 of the drawings, the board for dynamically universal time of the present invention comprises generally a hollow interior rectangular board 10 made from any suitable rigid material including a frame 11, a front panel 12 and a hinged back door 13. The front panel 12 insets in place into the frame 11 and has two alignments of display windows 121 and 122 parallel extended along the length and spacedly formed adjacent the upper border for respectively disposing in place of a plurality of LEDs which belong to an universal date column and an universal hour column respectively. The universal date column which lies above the universal hour column includes 25 date display windows 121 made in registry with the 24 time zones. It is understood that the M/Y time zone is centered by the International Date Line and includes two different dates therein so that there has to be two date display windows 123 displayed in this time zone. To cope with such situation, the M/Y time zone in the world map has also to be widened doubly. The universal hour column has 25 hour display windows 122 and the display window 124 in registry with the M/Y zone is also doubled but shows the same hour. The changes of the date in the universal date column and the hour in the universal hour column as well as the operations of the LEDs thereof will be discussed below.

In the lower middle portion of the front panel 12, there is large rectangular display window in which a set of LEDs are inset for displaying local time including hour minute and second by two figures. On the back side of the front panel 12, there is a set of circuit plates 30 and cords connected therebetween which are protected by the back door 13.

A world map 20 is attached to the front side of front panel 12. The map 20 which includes every country and major cities in the world is compiled by the Mercator Equator Projection and the longitude 142° 30'E is selected a central maridian 21. The longitudinal interval is 15 degrees so that the longitudes 22 divide the globe into 24 time zones 23 therearound. The zone number 24 is designated at lower end of every time zone by English letters by alphabet. Accordance with the International Criterian, the zone number is initiated from the standard time zone at Greenwich maridian which is numbered as "Z". Other time zones in the east longitude are numbered in sequence from A to M except "J" and those in the west longitude are likewise numbered in sequence from N–Y. So that the time zone at the International Date Line 25 (180th longitude) has a doubled number of M/Y. It is known that the universal time is calculated in accordance with the standard time at Greenwich (Z time zone), or the Greenwich Mean Time (GMT). Other zones in which the time kept differs hourly from the GMT are sequentially numbered and have either a negative prefix if east of Greenwich, or a positive prefix if west Greenwich. For avoiding any confusing may be caused by those positive or negative prefix to the users, these prefixed numbers are omitted in this instance, but the longitude for the central maridian of each odd numbered time zone has been labeled at it's lower end below the zone number which facilitates experts to refer to. At the upper end of each time zone, there is a color block 26 of transparent color which is arranged in the manner such that a first transparent color 27 applies to every odd numbered time zones and a second transparent color 28 for every even numbered time zones and then tints the same color to the countries in the corresponding time zones, and a third transparent color is used to apply those countries or regions whose standard time differs from the time zone by a fraction of an hour. Furthermore, a symbol in appropriate color is adapted to label the countries who adapt Summer time (Daylight saving time) or Winter time. All the arrangements discussed above are described in a legend 40 at the lower left corner of the world map 20. Note however that the boundaries of the countries may not wholly lie within the time zone. The standard Time is in the most cases that the zone of which the country mainly lies and the countries having longitudinal extend greater than one time zone may adopt more than one standard Time.

The time displayed in the universal time column 122 of the present invention is in binary number and is improved by not reference to the GMT Time in order to avoid the negative prefix, but directly reference to the local time 125 in which the hour is changed in consistence with a time zone through the center of the world map 20 (as shown in FIG. 1). On the map, the time within the time zones 23 east of the central time zone are hourly and sequentially increased and those west of the central time zone are hourly and sequentially decreased. For example, if the local time is 9 o'clock a.m., the time zone next to the central time zone will be 10 or 8 o'clock. So that the time within the 24 time zones is increased hourly in accordance with the progression of time in the local time column 125 from 1–24 hours. This improvement facilitates the popularity to readily know the time at 24 time zones with only a glance.

The date is also displayed in binary number and is changed in accordance with the International Date Line 25 which is a hypothetical line approximating the 180th maridian and is opposite to the prime maridian at Greenwich and where is the begining of a day. Therefore, the date west of the International Date Line is one day advanced in comparison with the date that east of the International Date Line. Since we are known that a new date begins from zero hour a.m. (in this instance "01" hour is adapted to represent 0–1 hour), so that the dates displayed in the universal date column 121 are one day less than the date across the west border of a time zone where becomes "01" hour. In this instance, the old date is supposedly 9th day and new date is 10th day. Note that an hour has 60 minutes. It is otherwise that each time zone contains the dynamic time from zero minute to sixty minutes for example, the twelve hour displayed within the M/Y zone substantially represents the time from 11:00 to 12:00 a.m., so that when the time displayed with a time zone is 01:00, it substantially represent the time from zero to one o'clock. That is why "01" is adapted in this instance instead of the "00" hour. In fact, "00" hour is included in the "01" hour. Although the date is changed at zero o'clock, it is included in the "01" hour that is very clear.

The LEDs for displaying date and hours are connected in series circuit with a CPU circuit plate in which a memory has been inputed with calendar program good for any future years. Once it starts to use, it will work permanently and accurately in consistence with the A.D. year, month, dates and hours without adjustment.

Since the Mercator Equator Projection has been characterized in that the central maridian of any time zone 23 can be centralized within the border of the map. So that any country or region in the world has equal chance to be centered in the world map 20. By this, the world map 20 of the present invention is variable to suit for countries of different locations. When the map is changed, the positions of the universal date and hour columns 121 and 122 remain unchanged, because a minor adjustment can make the LEDs that work in consistence with the circumstance of the map.

Figure 3:
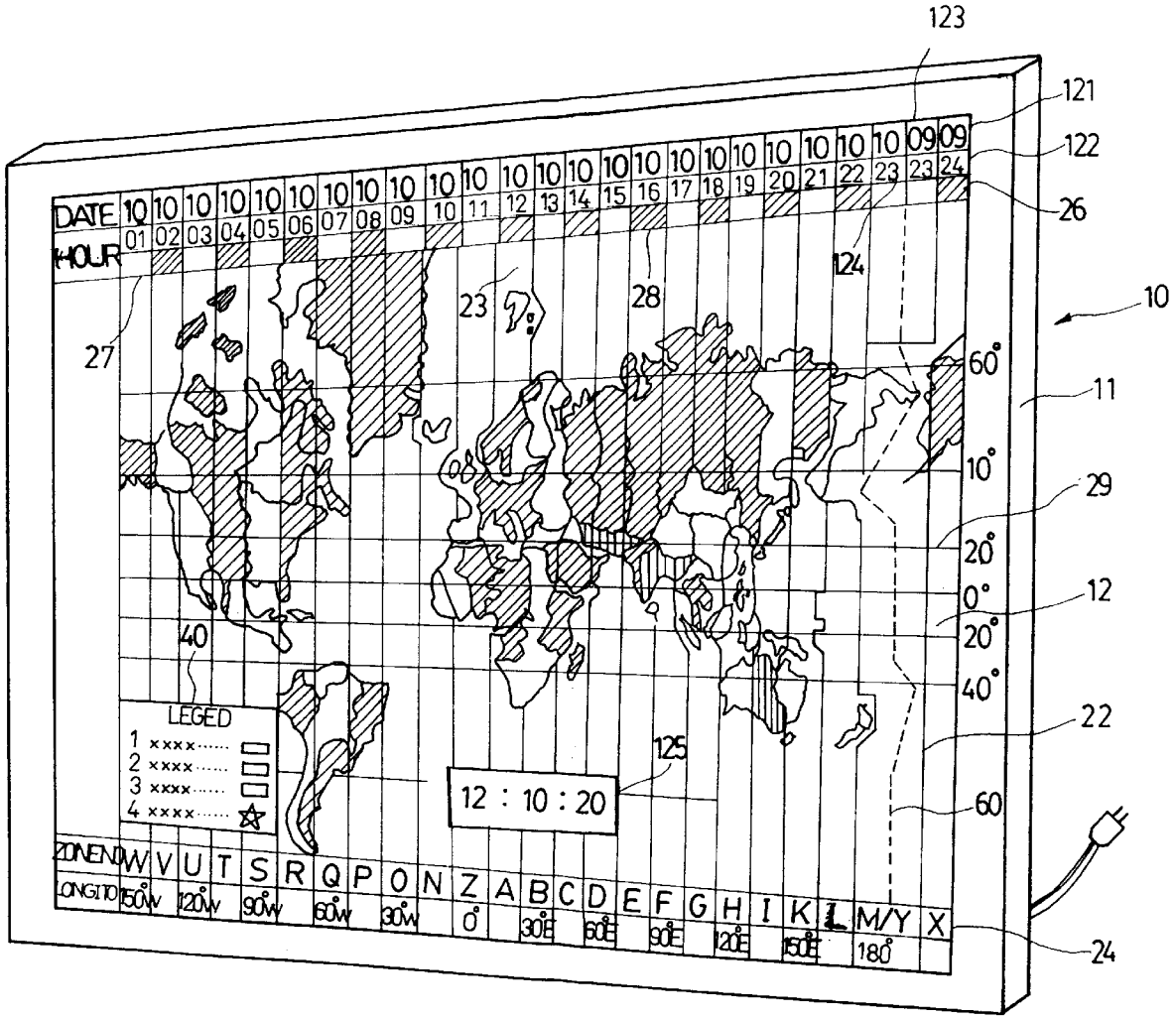
FIG. 3 is a perspective view to show the preferred embodiment of FIG. 1 after the shift of the central maridian of the Mercator Equator Projection.

Referring to FIG. 3 which shows a world map 20 in which the longitude 15° E is selected a central maridian of this map and the time zone A positioned at the central portion of the map so that most countries in Europe and Africa are centered within the border of the map. The International Date Line is also shifted to a new location nearby the right margin of the map. However, other items on the map remain unchanged except a minor adjustment to the local time column 125 in order to fit the local situation. Once the local time column 125 is adjusted, both the universal date display column 121 and the universal hours display column 122 will be worked in consistence with the change of the local time. Suppose the local time through the time zone A is 12:10:20, and the date is 10th day of a certain month, the time displayed at the time zones 23 east of zone A are advanced hourly such as 13, 14, 15, . . . , and the time displayed at the time zones 23 west of zone A are hourly subtracted such as 11, 10, 9, . . . , where the date displayed at the most time zones 23 is 10th day except one and half time zones 23 positioned east of the International Date Line where still remains in 9th day. Note that the International Date Line is centered at the time zone M/Y where includes two different date but in the same hour, it is otherwise that there must be two date display windows and one or two identical hour display windows inset in that time zone. However, the problem is that if a pair of small sized date display LEDs are adapted to fit the wide of the zone, it will cause that the dates displayed are invisible to the mass and impairs the uniform outlook of the time board, besides, it may influence the uniform operatin of the circuit plates technically and electronically.

To solve this problem, the time zone M/Y has been widened doubly to contain a pair of date display LEDs and a pair of hour display LEDs. However, when the pair of the date display LEDs display different dates, the pair of the hour display LEDs display the same hour. In conformity with such situation, the terretory of the countries or region within this time zone have to be enlarged relative to the others. But it will not cause any misunderstanding to the mass. Nevertheless, this alteration provide a possibility to properly display a spherical aspect on a planar surface which is an important feature of the present invention. The latitude in this world map is also a set of parallel straight lines which are flattened northward or southward relative to the Equator where the latitude is zero. To prevent the terretories in the high latitude from to be over enlarged the latitudinal intervals for high latitudes are relatively shortened.

Figure 6:
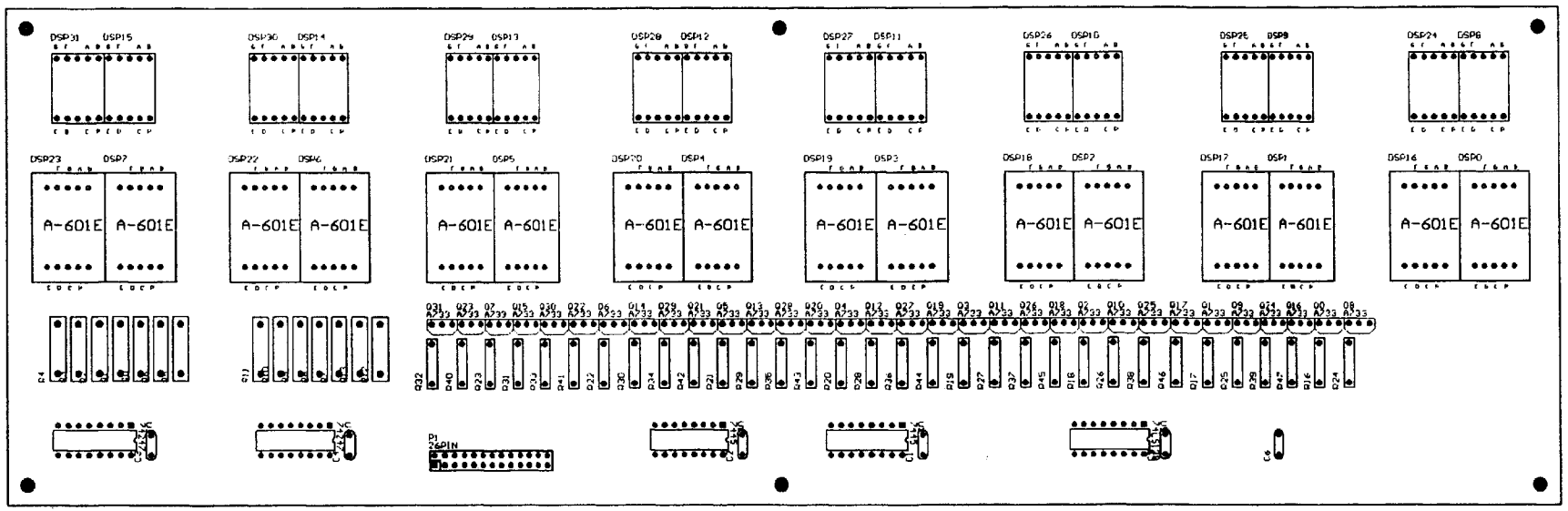
FIG. 6 is a plane view to show a date and hour display circuit plate.
Figure 7:
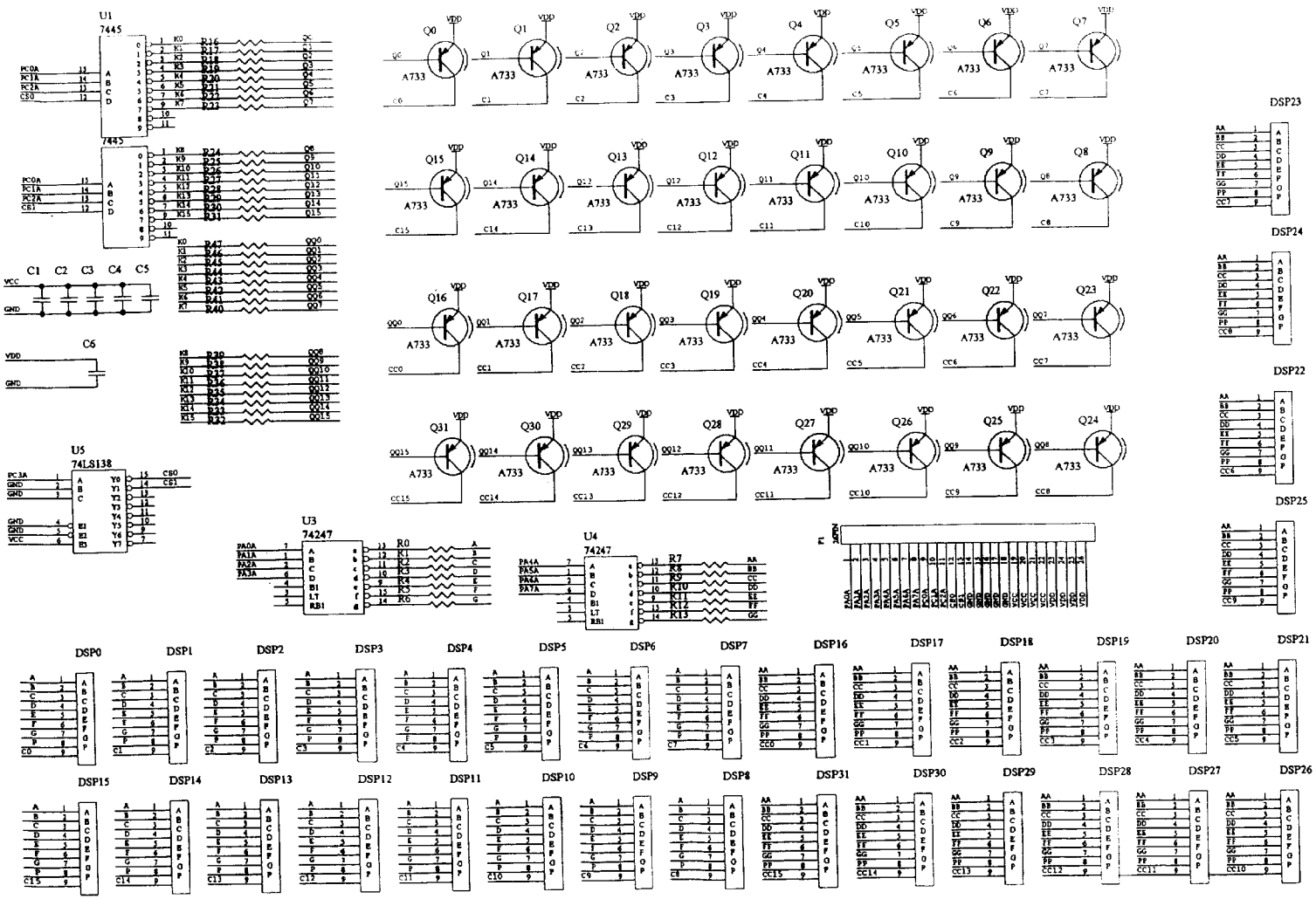
FIG. 7 is a diagram of the date and hour display circuit.
Figure 8:
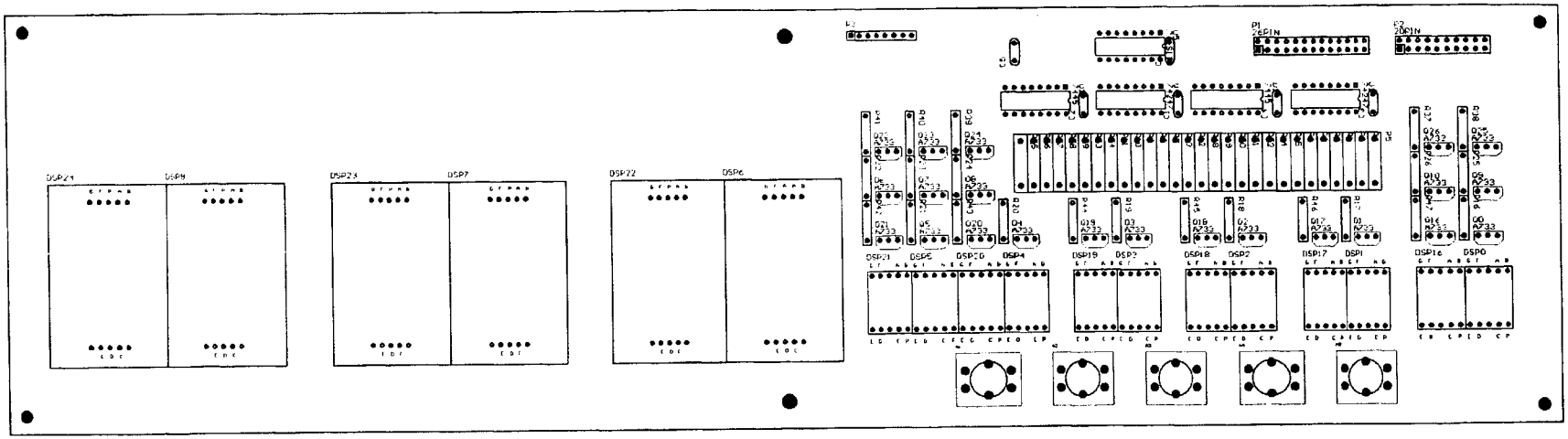
FIG. 8 is a plane view to show a local time display circuit plate.
Figure 9:
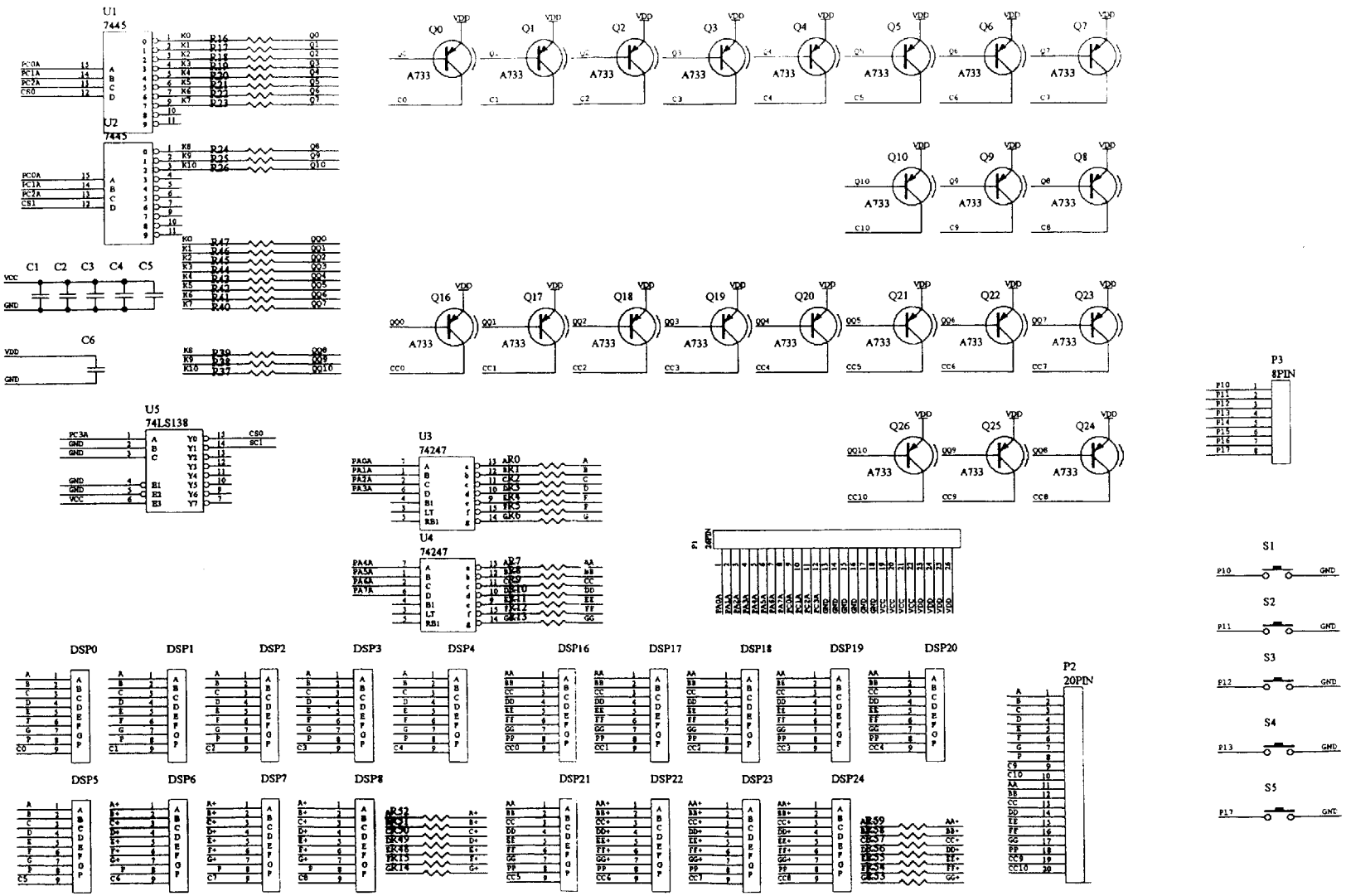
FIG. 9 is a diagram of the local time display circuit.

Referring to FIG. 2 of the drawings, you'll see that the electronic device 30 of the present invention uniformly disposes to the back side of the front panel 12, the device 30 includes generally a CPU circuit board 31 positioned at appropriate central portion of the panel 12, three identical date and hour display circuit boards 32 (as shown in FIGS. 6 and 7) disposed along the upper border and connected in series circuit with the CPU circuit board and each containing eight date display units and eight hour display units which are relatively connected with the LEDs in the universal date display column 121 and the universal hour display column 122, a local time display circuit board 35 ( as shown in FIGS. 8 and 9) disposed below the CPU circuit board and connected in series with the CPU circuit 31 and the LEDs in the local time column 125 and containing three time display units for relatively displaying the hour (351), minute (352) and second (353) by binary number, an adjustment device (36) extended rightward from the right end of the local time display circuit board 35, the device includes five adjusting buttons 361 in confront of four small binary numbered display windows 362 and a four numbered small display window 363. The adjusting buttons 361 includes a function transition button F, a month adjusting button MO, a date adjusting button D, a hour adjusting button H and a minute adjusting button M. The adjusting results are displayed respectively in the small binary numbered windows 262 except the four numbered small display window 263 where, the A.D. year is displayed. An additional universal date and hour display circuit board 37 disposes in corporation with other three date and hour display circuit board 32, in which includes only a single date and hour display units so that it makes totally 25 date and hour display units in this invention to cooperate with the 25 display windows both in the universal date display column 121 and the universal hour display column 122. This single circuit board 37 is connected in series with the CPU circuit board via the local time circuit board 35 and worked in concert with other date and hour display circuit board 32. Substantially, the date and hour display circuit board in this invention can be connected in series with 25 single ones or a single circuit board is adapted containing both 25 date and hour display units, depending upon the size of the time board.

Figure 4:
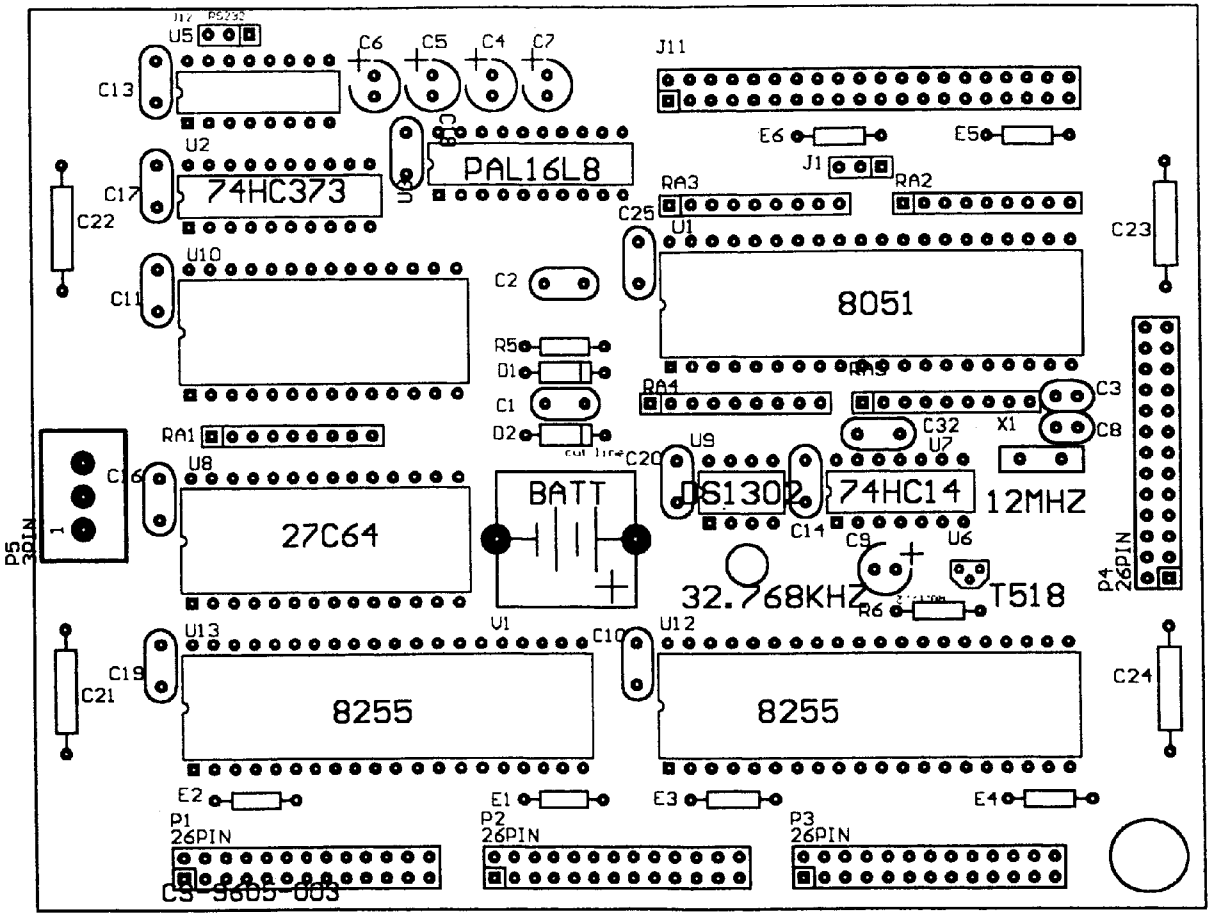
FIG. 4 is a plane view to show a CPU circuit plate.
Figure 5:
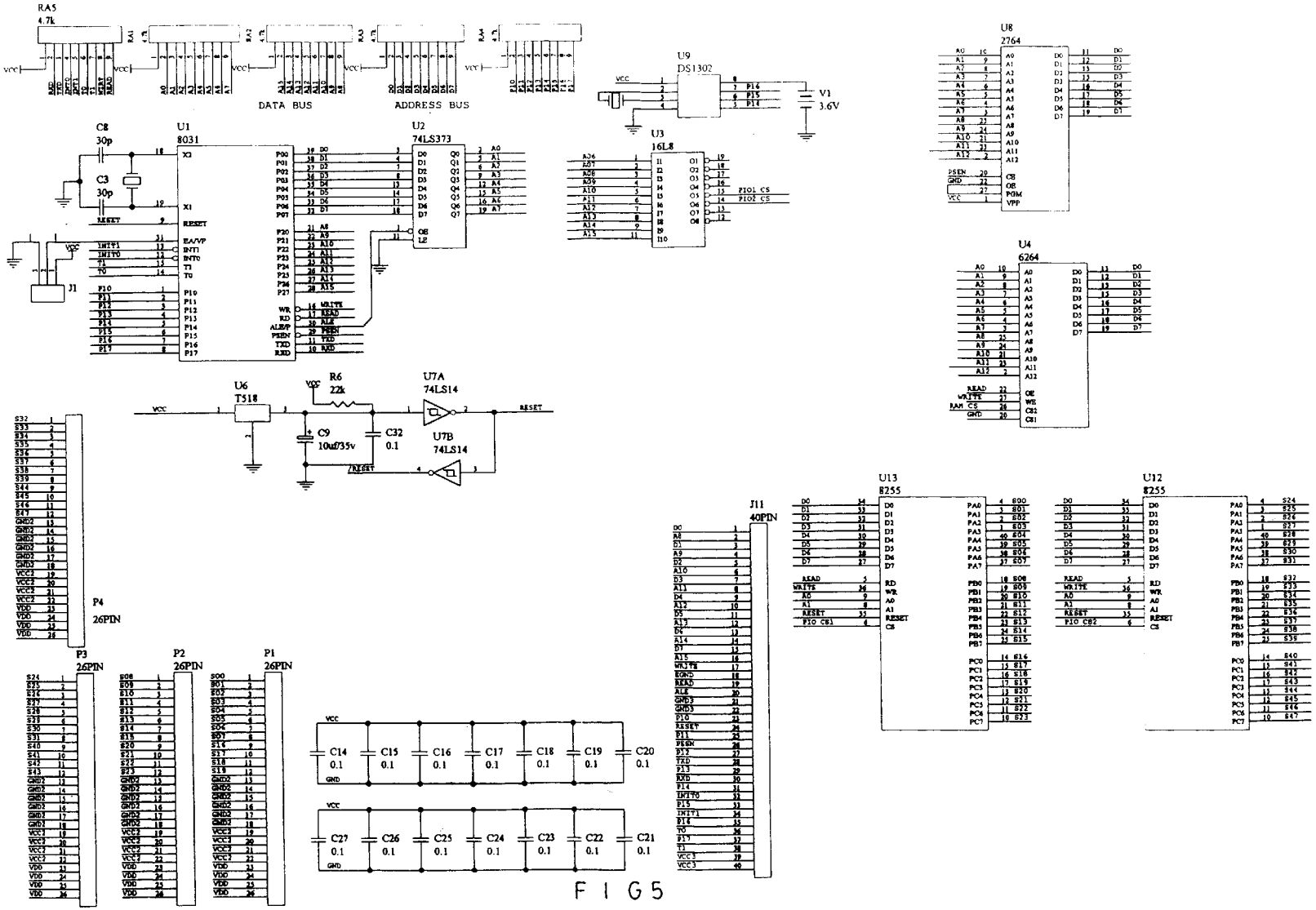
FIG. 5 is a diagram of the CPU circuit.

The CPU circuit board 31 (as shown in FIGS. 4 and 5) is of an INTEL Co. 8051 main process system with external ROM module and includes a High level T518 power source detector for supervising the stability of the system voltage in order to decide whether or not it is RESET, a 74HC14 sumit circuit for modifying the reverse current and the signal to prevent the system from misunderstanding of the signal and the interruption of the noise, a ST27C64EPROM for storing all system programs, a T1174HC373 for locking the A0-D7 address line to separate the address line from the data line in order to facilitate external reading, storing, output and input process without mutual interruption, and a TI16L8 two-address selection units 8255 for scanning the BCD code and numbering post and read by pressing the button. The main timing circuit adapts DALLAS Co. DS1302 in addition to a 32,768 HZ quartz and a 3.6V rechargeable battery so as to ensure that the counting of time will not stop during a power interruption. Besides, the CPU(805) can automatically take the correct data of the A.D. year, month, date, hour and minute from DS1302 and then makes appropriate disposition and displaying the data. The power source of this invention is of a DC TO DC type. The input terminal of the transformer 38 is of a AC 110V/220V selective type and it's output will be DC 12V/3 A which, through a high speed reverse by a TIP107 and a voltage stabilizing by a 7805(39) will become stable 5V/3 A max power under inductive storage for supplying the system computer and its perimeter IC (7447 and 7445). The unstable 12V current, after rectification and wave filtering via a bridge rectifier supplies to the LEDs so as to reduce the system volume and the temperature of the power source. Furthermore, the power system of the present invention is charaterized in that when the pair of 8255 units output BCD code, the TTL 7447 unit will decode it and in cooperation with TTL 7445 to scan the numbering post for displaying. Because the pair of the TTL IC are of open electric pole which can serve for the current having voltage higher than 5V. The electrically unstabilized power display is of a common anode structure which facilitates the adaption of 2SA733 transistors to perform current magnification at the common connection points of the display for providing more adequate energic current, in order that the display, under high speed scanning can emit bright light for the mass to watch. Besides, the calendar program good for any future years has been stored therein, after commencement of this time board, it will work smoothly to dynamically show the universal date and hour in accordance with the days of the months, the leap year or common year.

At first commencement, when the power is supplied, you'll see that all the LEDs in the columns begin to work. The dates in the universal date display column 121 are presented such that the dates in the time zones 23 west of the International Date Line 123 are one day advanced to those east of the Line 123 and the time in the universal hour display column 122 is hourly and sequentially advanced in every time zones from the west border to the east board of the map 20, but the hour displayed in the local time column 125 consists with that displayed in a time zone through the center of the map 20. So that the time displayed in the local time column has to be adjusted to consist with the substantial circumstance by operating the adjustment device 36 on the back of the front panel 12.

Figure 10:
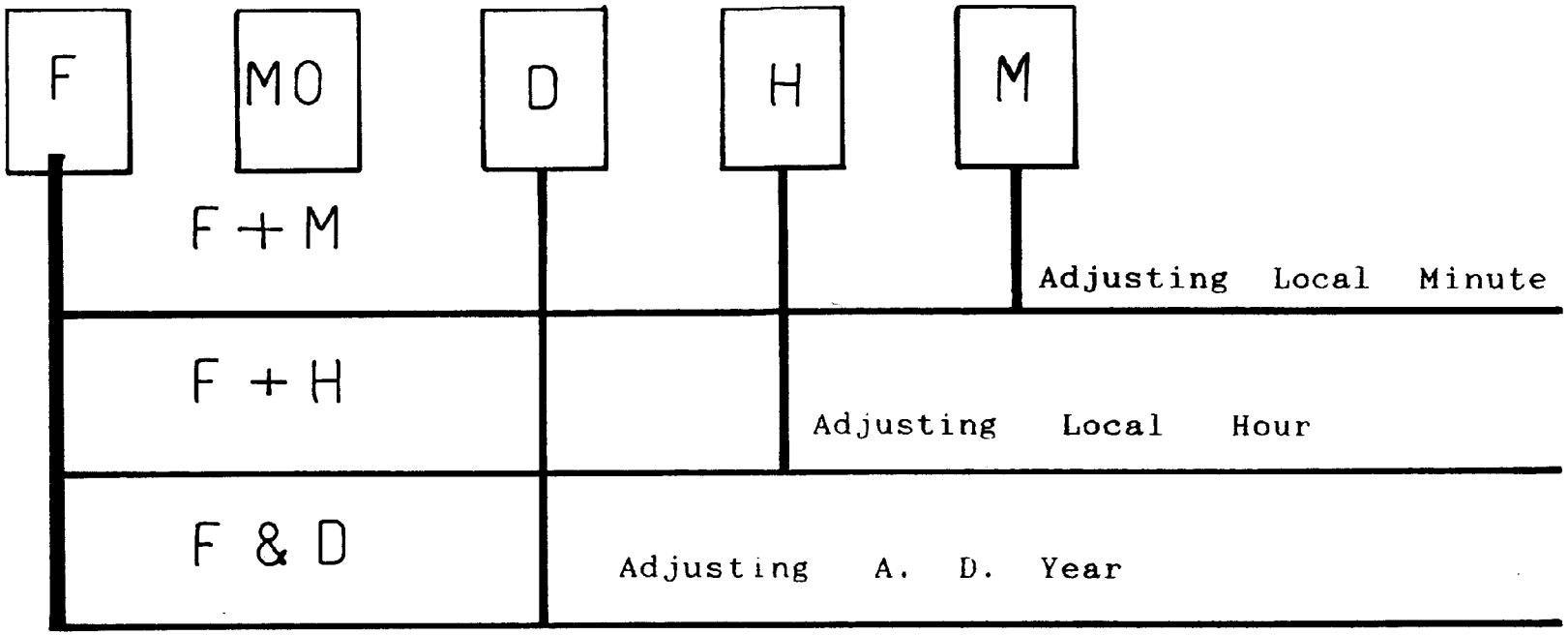
FIG. 10 is a diagram to indicate the operation of an adjustment device.

Referring to FIG. 10 of a diagram which illustrates the adjustment process. First soly press down the button F and the button D to adjust the A.D. year, you'll see the four numerals supposedly "1996" in the display window 363 (omit this step if the A.D. year is found correct), and then soly and sequentially press down the buttons MO, D and M to respectively adjust the month of the present year, the date in the universal date display column 121 and the minute to start in concert with GMT time, once the button M is released, the second on the local time column begins to work steadfastly. However, when adjusts the hour and minute in the local time columnn 125, it must simultaneously press down the button F+button H and the button F+button M.

When completes the adjustment discussed above, the local time in the local time column 125 works normally and smoothly and consists with the hour displayed in the time zone 23 through the center of the map 20. The hours displayed in the other time zones 23 east of central time zone are hourly and sequentially advanced and those west of the central time zone are hourly and sequentially subtracted. The dates displayed in the universal date display column 121 are one day advanced where west of the International Date Line and in consistence with the present date. This improvement provide a great advantage of that to display the spherical data onto a planar surface and to simplize the complicated and expert universal time system for common use. People can get the present time within every time zone 23 around the world just at a glance, without considering why or how it is conversed from the GMT time or why the date has to be changed in accordance with the International Date Line. But they can readily predict the time of arrival at their destinations. However, the experts can also easily enter into the situation by reference to the alphabet zone numbers and the longitude at the lower end of the time zone 23. Because of a 3.6V rechargeable battery adapted to this system, it will work continuously during a power interruption.

The time board of the present invention can also assist in navigations. When the time board is adopted to an aircraft or a ship, the user can reset the local time column 125 for the local time of their destinations. This will help them to arrange and control the operations on their ways and enjoy the similar time at the arrival. However, the time displayed in the universal time display column become inconsistent with time zones 122 in the world map 12. Neglect this inconsistency temporarily and turn it back to the original local time when returns to where they were. Then the time board works normally.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

We claim:

1. A device for dynamically displaying universal time comprising:

a flat rectangular board having a rectangular frame, a front panel inserted in the frame and a back cover hinged to a rear side of the frame;

said front panel having a universal date display column and a universal hour display column parallel to and adjacent the frame from left to the right margin of the front panel, each including 25 display windows confronted with 24 time zones of the world for inserting therein a plurality of LEDs to dynamically display the change of dates and hours around the world;

a local display column at an appropriate position of a lower portion of said front panel for inserting therein a plurality of LEDs to dynamically display the hour, minute and second of the local time, wherein the LEDs are a binary numbering structure and connected with and operated by a plurality of IC boards, a CPU board and a control device disposed in series to a back side of the front panel;

a world map attached to the front side of the front panel including all of the countries and major cities in the world, said map being compiled with the Mercator Equator Projection having 24 time zones divided by a set of longitudes of 15 degrees interval, said time zone being designated with letters of alphabet at a lower end with the time zone M/Y in which the International Date Line is centered being doubly widened to coinside with a pair of display windows of said universal date display column and said universal hour display column and longitude denoted below the alphabet numbers for the central maridian of each odd numbered time zone;

a first transparent color applied to a color block at an upper end of each odd numbered time zone and a second transparent color applied to a color block at an upper end of each even numbered time zone and tinting said transparent colors respectively to those countries and/or regions located within said corresponding time zones;

a third transparent color applied to the countries and regions whose standard time differ from the time zone by a fraction of an hour;

a symbol of appropriate color adapted to label countries who adapt Summer time (Daylight saving time) or Winter time;

a legend for describing the above data positioned at lower corner of said world map.

2. A device according to claim 1 wherein said IC boards include an universal date and time display circuit board containing 25 date display units and 25 hour display units and a local time circuit board containing an hour, a minute and a second display units and connected in series with said control device and said CPU circuit board, said units being respectively connected to their corrsponding LEDs.

3. A device according to claim 1 wherein said CPU circuit board includes a ROM being inputed with a calendar good for any future years and a 3.6V rechargeable battery which ensures that said device can work constantly and continuously without stopping during a power interruption.

4. A device according to claim 2 wherein said local time circuit is combined with said control device and is adjustable by said control device, the adjusted hour displayed in said local time column being worked in concert with the hour displayed within a time zone centralized in said world map.

5. A device according to claim 1 wherein said control device includes five adjusting buttons incorparated with five small display windows for respectively adjusting the A.D. year, month, date, hour and minute.

6. A device according to claim 5 wherein said minute adjusting button is released at the same time while the second unit begins to work in conforming with the GMT time.

7. A device according to claim 1 wherein said Mercator Equator Projection is characterized in a selective central maridian so as to facilitate preparing different world maps to show any country and/or region to be centered within said map.

8. A device according to claim 2 wherein said universal date and hour display columns are adjustable to conform with the changes of said world map.

9. A device according to claim 1 wherein the hour displayed in said universal hour display column is hourly and sequentially increased from west to eastward and the date displayed in said universal date display column is advanced one day west of the International Date Line.

10. A device according to claim 1 wherein said device can be adapted to navigation for scheduling and controlling the operation of the crew on sailing and enjoying the exact local time at arrival.

* * * * *